US006989809B1

(12) United States Patent
Inage

(10) Patent No.: US 6,989,809 B1
(45) Date of Patent: Jan. 24, 2006

(54) LIQUID CRYSTAL DISPLAY

(75) Inventor: Fumiaki Inage, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/378,519

(22) Filed: Aug. 20, 1999

(30) Foreign Application Priority Data

Aug. 24, 1998 (JP) ..... 10-237805

(51) Int. Cl.
*G09G 3/36* (2006.01)

(52) U.S. Cl. ..... 345/98; 345/95

(58) Field of Classification Search ..... 345/88, 345/89, 95, 98, 147; 348/790, 791, 572
See application file for complete search history.

(56) References Cited

U.S. PATENT DOCUMENTS

| | | | | |
|---|---|---|---|---|
| 4,523,232 A | | 6/1985 | Kameda et al. | |
| 4,642,693 A | * | 2/1987 | Fuse et al. | 348/791 |
| 4,642,694 A | * | 2/1987 | Yamagishi et al. | 348/790 |
| 4,745,461 A | * | 5/1988 | Shirai et al. | 348/572 |
| 5,504,538 A | | 4/1996 | Tsujihara et al. | |

FOREIGN PATENT DOCUMENTS

| | | |
|---|---|---|
| JP | 04343325 | 11/1992 |
| JP | 05176264 | 7/1993 |
| JP | 07231255 | 8/1995 |

* cited by examiner

*Primary Examiner*—Kent Chang
(74) *Attorney, Agent, or Firm*—Brinks Hofer Gilson & Lione

(57) ABSTRACT

The invention provides a liquid crystal display that does not deteriorates the picture quality and facilitates the contrast adjustment with a simple construction. In order to achieve the object, the liquid crystal display of the invention contains A/D converters that convert the luminance signal Y and the two color-difference signals (Pr, Pb) of an input video signal each into digital signals in correspondence with the respective signals, and a variable power supply that sets the magnitudes of the reference voltage ranges to determine the upper limit voltages and the lower limit voltages of the digital signals to one identical magnitude, which is given to each of these A/D converters. The digital signals outputted from these A/D converters and the synchronizing signal outputted from the PLL circuit are inputted to the PLD, and these digital signals are outputted to the subsequent scanning line driving circuit and the signal line driving circuit synchronously with the synchronizing signal, thus displaying the picture images on the liquid crystal panel.

10 Claims, 5 Drawing Sheets

LIQUID CRYSTAL DISPLAY

BACKGROUND OF THE INVENTION

1. Field of the Invention

The present invention relates to a liquid crystal driving circuit, especially to a liquid crystal display for the NTSC system, PAL system, and HDTV high vision system.

2. Related Art

First, the signals inputted to the display of a television will briefly be explained.

FIG. 4 illustrates a color bar. As widely known, the color bar generally displays different colors sequentially in the lateral direction of the display screen. For example, FIG. 4 gives the color bar that arrays 'white', 'yellow', 'cyan', 'green', 'magenta', 'red', 'blue', 'black' sequentially from the left to the right.

FIG. 5 is a timing chart to show the RGB signal and the horizontal synchronizing signal that constitute a scanning line, when the color bar shown in FIG. 4 is displayed.

The RGB signal shown in FIG. 5 bears a voltage between 0 volt and 0.7 volt. The horizontal synchronizing signal bears a voltage value between 0 volt and −0.3 volt.

Here, for simplicity, the RGB signal is assumed to take 0 volt or 0.7 volt; and in case of 0 volt, it is called Low level, and in case of 0.7 volt, it is called High level.

The time domains indicated by the symbols $T_1$ to $T_8$ in FIG. 5 represent the time intervals that display the colors corresponding to each colors in the color bar in FIG. 4. The time domain $T_1$ displays 'white', the time domain $T_2$ displays 'yellow', . . . , and the time domain $T_8$ displays 'black'.

In other words, since the time domain $T_1$ gives High level to any of the R signal, G signal, and B signal, it displays the white; since the time domain $T_2$ gives High level to the R signal and G signal only, it displays the yellow; . . . ; and the time domain $t_8$ gives Low level to any of the R signal, G signal, and B signal, it displays the black.

Next, the method of displaying the color bar shown in FIG. 4 will be discussed with reference to the composite signal in practical use for the television broadcasting (including HDTV).

FIG. 6 is a timing chart to illustrate the luminance signal and the color-difference signal that constitute a scanning line, when the color bar shown in FIG. 4 is displayed.

The composite signal consists of the luminance signal (Y), the color-difference signal Pr (R−Y), and the color-difference signal Pb (B−Y).

The luminance signal (Y) is an analog signal having the value from −0.3 V to 0.7 V. When the value is positive, it is used to display the luminance, and when the value is negative, it is used as the horizontal synchronizing signal. Namely, the signal with the symbol $S_H$ applied is used as the horizontal synchronizing signal. In the example shown in FIG. 6, the value 0 V represents the black level; and the value 0.7 V represents the white level.

The color-difference signal Pr is acquired by subtracting the luminance signal from the red signal (R), which is an analog signal covering from −0.35 V to 0.35 V. The color-difference signal Pb is acquired by subtracting the luminance signal from the blue signal (B), which is an analog signal covering from −0.35 V to 0.35 V.

When the color bar shown in FIG. 4 is displayed, the luminance signal (Y) assumes a wave-form that decreases the values in a step-form, and the color-difference signals Pr, Pb assume wave-forms corresponding to the colors. For example, to display the white, the color-difference signals Pr, Pb both assume 0 V, and the luminance signal assumes 0.7 V, which is the maximum value. Further, to display the magenta, the luminance signal assumes 0.35 V, the color-difference signal Pr assumes about 2.6 V, and the color-difference signal Pb assumes about 3. V.

Next, a conventional liquid crystal driving circuit relating to the liquid crystal display will be discussed.

FIG. 7 is a chart to illustrate a construction of the conventional liquid crystal driving circuit. FIG. 7 illustrates only the part where an inputted analog signal is converted into a digital signal. This liquid crystal driving circuit is provided to each of the luminance signal (Y), the color-difference signal Pr, and the color-difference signal Pb of the inputted composite signal.

In FIG. 7, a reference numeral 50 denotes an amplifier that amplifies the luminance signal (Y), the color-difference signal Pr, and the color-difference signal Pb inputted thereto, and a variable resistor 51 for adjusting the amplification factor is connected. The amplifier 50 is used for adjusting the contrast.

The variable resistor 51 is normally a semi-fixed type, and to vary the resistance will vary the amplification of the amplifier 50.

A reference numeral 52 signifies an analog/digital converter (hereunder referred to as A/D converter). Receiving the output from the amplifier 50, the A/D converter performs the sampling and quantization of the input signal to output a digital signal D. Normally, this digital signal D is a 8-bit parallel signal.

A reference numeral 53 signifies a power supply to determine the upper limit voltage that defines the maximum value of the input signal corresponding to the maximum value of the digital signal D outputted from the A/D converter 52. A reference numeral 54 signifies a power supply to determine the lower limit voltage that defines the minimum value of the input signal corresponding to the minimum value of the digital signal D outputted from the A/D converter 52. The values of these power supplies 53, 54 are fixed.

Further, a reference numeral 55 denotes a variable power supply that defines the intermediate voltage value between the upper limit voltage and the lower limit voltage. This variable power supply 55 can vary the output voltage.

In the foregoing construction, first the variable power supply 55 is adjusted to set the intermediate voltage between the upper limit voltage defined by the power supply 53 and the lower limit voltage defined by the power supply 54.

When the luminance signal and the color-difference signal Pr or the color-difference signal Pb are inputted to the amplifier 50, the signals are amplified by a specific amplification factor, which are inputted to the A/D converter 52. The A/D converter 52 samples and quantizes the inputted signals, using the upper limit voltage, the lower limit voltage, and the intermediate voltage that are defined by the power supply 53, the power supply 54, and the variable power supply 55, respectively, as the thresholds, converting into the digital signal D to output.

The digital signal outputted from the A/D converter 52 is transformed into the RGB signal on the basis of the following arithmetic expression.

$$R=Y+Pr$$

$$B=Y+Pb+Pb/4$$

$$G=Y-Pb/4-Pr/2$$

In this expression, the processings of ½ and ¼ are carried out by the bit shift.

The contrast of the picture images is adjusted by varying the resistance of the variable resistor 51 to thereby vary the amplification factor of the amplifier 50.

In the foregoing conventional technique, the contrast adjustment is carried out by varying the amplification factor of the amplifier 50 by using the variable resistor 51 shown in FIG. 7.

In this case, the amplifier 50 requires a circuit to vary the amplification factor in addition to a circuit to conduct the amplification, which makes the circuit construction complicated. A complicated circuit construction will easily invite external noises to give an adverse effect to the picture quality, which is a problem.

Further, the circuit shown in FIG. 7 is provided to each of the luminance signal (Y), the color-difference signal Pr, and the color-difference signal Pb, as mentioned above.

However, to vary only the amplification factor of the amplifier 50 in the circuit that is provided to the luminance signal (Y), for example, will vary the color to be displayed in practice, which is a problem. This results from that the luminance signal (Y), the color-difference signal Pr, and the color-difference signal Pb are associated as to the color with each other in the composite signal, as mentioned above.

Accordingly, it becomes necessary to adjust in such a manner that the amplification factors of the amplifiers 50 in the circuits provided to each of the luminance signal (Y), the color-difference signal Pr, and the color-difference signal Pb are equal.

However in the conventional technique, since the amplification factors of the amplifiers 50 are each adjusted by the variable resistors 51 individually, it is difficult to adjust these amplification factors to be equal.

SUMMARY OF THE INVNTION

The present invention has been made in view of the foregoing circumstances, and it is an object of the invention to provide a liquid crystal display that facilitates the contrast adjustment without deteriorating the picture quality with a simple circuit construction.

In order to solve the foregoing problems, the liquid crystal display according to the invention comprises conversion means that convert a luminance signal and two color-difference signals of an input video signal each into digital signals in correspondence with the respective signals, and setting means that sets magnitudes of reference voltage ranges to determine upper limit voltages and lower limit voltages of the digital signals to be identical to each of these conversion means.

Here, the luminance signal and two color-difference signals of the above-mentioned video signal are the signals based on the video signals of the HDTV system, the NTSC system, or the PAL system. When the input video signal is a signal based on the HDTV system, the luminance signal Y with the signal bandwidth of 30 MHz, the color-difference signals Pr and Pb are inputted to each of the conversion means, and the magnitudes of the reference voltage ranges of each of these conversion means are set to one identical magnitude by the setting means. Further, when the input video signal is a signal based on the NTSC or the PAL system, the luminance signal Y with the signal bandwidth of 4.2 MHz, the color-difference signal R−Y of the signal bandwidth of 2 MHz (Pr signal obtained by subtracting the luminance from the red) and the color-difference signal B−Y (Pb signal obtained by subtracting the luminance from the blue) are inputted to each of the conversion means, and the magnitudes of the reference voltage ranges of each of these conversion means are set to one identical magnitude by the setting means.

According to this invention, only varying the magnitudes of the reference voltage ranges by the setting means will facilitate the contrast adjustment.

Further, since the device construction is simple, the external noises are difficult to be merged in, and the picture quality is difficult to be deteriorated.

Further, the setting means in this invention sets a minimum value of the reference voltage ranges to a minimum value of the input video signal, and varies an intermediate value between the minimum value of the reference voltage ranges and a maximum value thereof, in accordance with a variation of the maximum value of the reference voltage ranges.

According to this invention, to vary the magnitudes of the reference voltage ranges will automatically vary the intermediate value of the maximum and the minimum of the reference voltage ranges, whereby the adjustment of the intermediate value is made unnecessary.

DESCRIPTION OF THE PREFERRED EMBODIMENT

The liquid crystal display according to one embodiment of this invention will now be discussed in detail with reference to the accompanying drawings.

Figure 1:
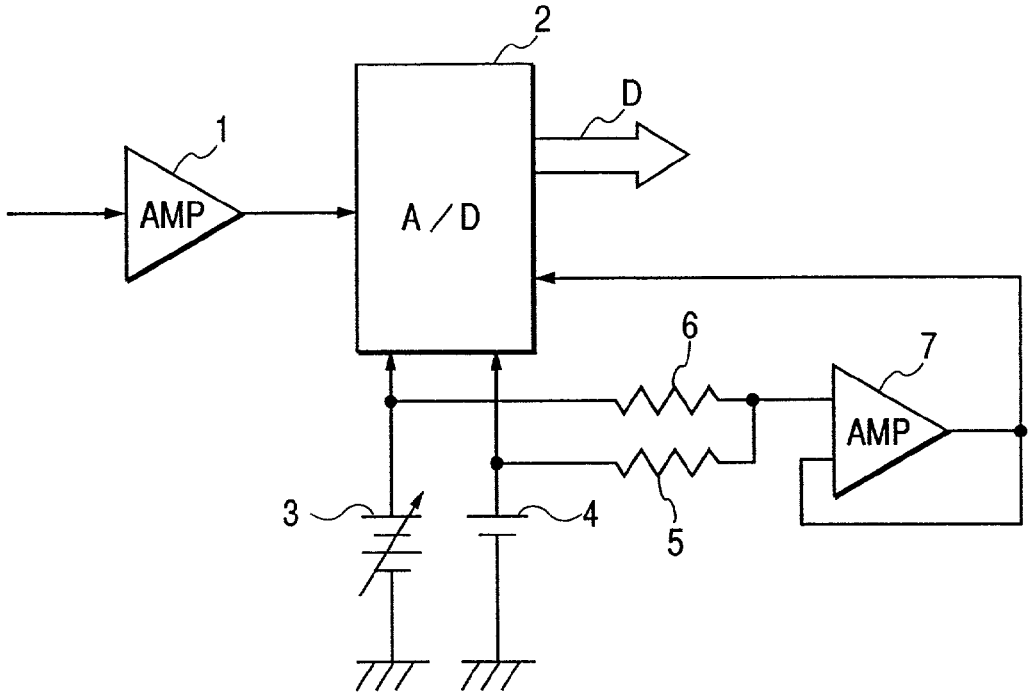
FIG. 1 is a block diagram to illustrate the basic construction of a liquid crystal driving circuit relating to the liquid crystal display according to one embodiment of the present invention.

In FIG. 1 is a block diagram to illustrate the basic construction of a liquid crystal driving circuit relating to the liquid crystal display according to one embodiment of this invention. The liquid crystal driving circuit shown in FIG. 1 is provided to each of the color-difference signal Pr and the color-difference signal Pb (these signals constitute the high vision signal). The luminance signal (Y) is amplified by a similar circuit that does not contain the resistors 5,6 or buffer amplifier 7.

In FIG. 1, a reference numeral 1 denotes an amplifier, which amplifies the luminance signal (Y), the color-difference signal Pr, and the color-difference signal Pb inputted thereto with a specific amplification factor. The difference of the amplifier 1 from the amplifier 50 shown in FIG. 7 lies in that the circuit for varying the amplification factor is omitted. A reference numeral 2 denotes an A/D converter, which is the same as the A/D converter 52 shown in FIG. 7.

Further, a reference numeral 3 denotes a variable power supply to determine the upper limit voltage that defines the maximum value of the input signal corresponding to the maximum value of the digital signal D outputted from the A/D converter 2. A reference numeral 4 denotes a power supply to determine the lower limit voltage that defines the minimum value of the input signal corresponding to the minimum value of the digital signal D outputted from the A/D converter 2.

Since the variable power supply 3 is able to vary the output voltage of its own, the upper limit voltage to define the maximum value of the input signal corresponding to the maximum value of the digital signal D becomes variable. Therefore, the contrast adjustment is made possible by varying this variable power supply 3.

Figure 7:
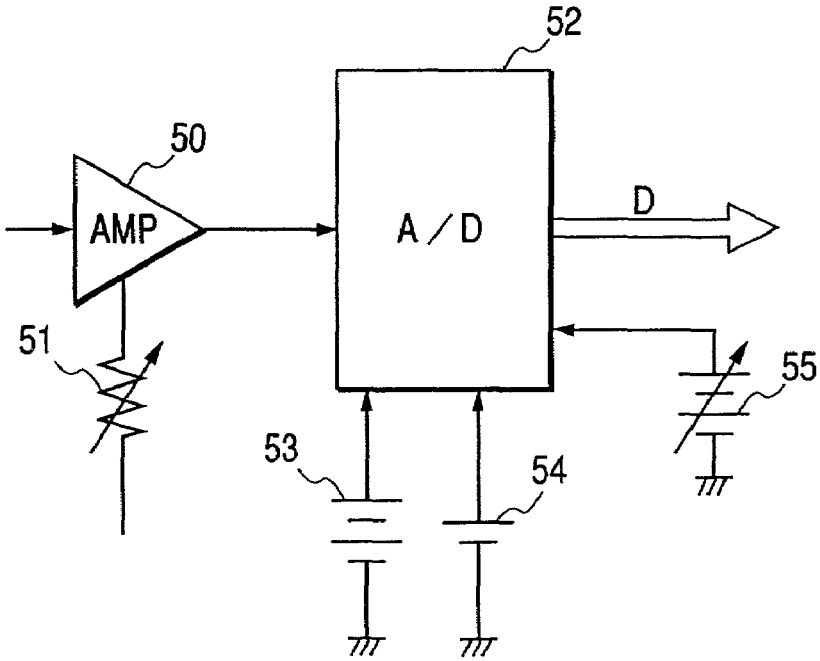
FIG. 7 PRIOR ART
FIG. 7 is a chart to illustrate the construction of a liquid crystal driving circuit relating to the conventional liquid crystal display.
Figure 5:
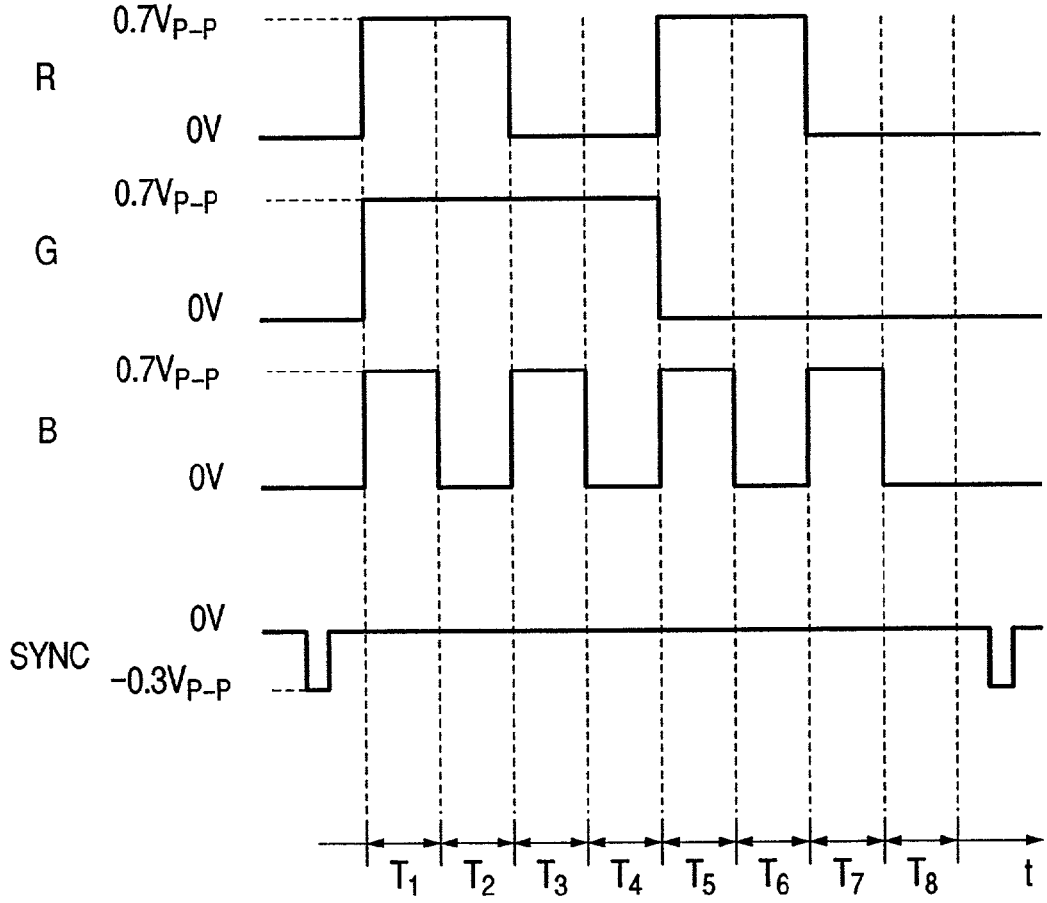
FIG. 5 PRIOR ART
FIG. 5 is a timing chart to illustrate the RGB signal and the horizontal synchronizing signal that constitute one scanning line, when displaying the color bar shown in FIG. 4.

The reference numeral 4 is a power supply to determine the lower limit voltage that defines the minimum value of the input signal corresponding to the minimum value of the digital signal D outputted from the A/D converter 2, which is similar to the power supply 54 shown in FIG. 7.

A reference numeral 5 signifies a resistor, one end of which is connected to the power supply 4 and the A/D converter 2. A reference numeral 6 signifies a resistor, one end of which is connected to the variable power supply 3 and the A/D converter 2. The other ends of these resistors 5, 6 are connected to each other. The resistors 5, 6 are to acquire the intermediate voltage between the upper limit voltage defined by the variable power supply 3 and the lower limit voltage defined by the power supply 4.

A reference numeral 7 signifies a buffer amplifier, one input terminal of which is connected to the other ends of the resistors 5, 6. And, an output terminal of the buffer amplifier 7 is connected to the other input terminal of its own, and connected to the A/D converter 2.

The output voltage from the buffer amplifier 7 is the intermediate voltage.

In this construction, to vary the output voltage of the variable power supply 3 will vary the upper limit voltage. On the other hand, the output of the power supply 4 to define the lower limit voltage is fixed. To vary the upper limit voltage by the variable power supply 3 will vary a voltage divided by the resistor 5 and the resistor 6, which is inputted to the buffer amplifier 7. This voltage is inputted through the buffer amplifier 7 to the A/D converter 2 as the intermediate voltage.

As described above, in this embodiment, by varying the upper limit voltage, the intermediate voltage is automatically obtained by the varied upper limit voltage and the fixed lower limit voltage, and is inputted to the A/D converter 2.

Thus, the color-difference signal Pr and the color-difference signal Pb inputted to the amplifier 1 are amplified by the amplifier 1 and digitized by the upper limit voltage and intermediate voltage that are newly set. Correspondingly, the luminance signal is amplified by a similar amplifier 1 and digitized by the upper and lower limit voltages, as the circuit that sets the intermediate voltage is not included.

In this embodiment, as explained above, since the contrast adjustment can be made only by varying the variable power supply 3 to vary the upper limit voltage of the A/D converter 2, the total circuit construction will be simplified. Since the possibility of a noise mixture is reduced, the picture quality will be maintained without deterioration, and the contrast adjustment can be made with ease.

As explained in the conventional technique, when any one of the amplification factors (amplification factor of the amplifier 50 in FIG. 7) of the luminance signal (Y), the color-difference signal Pr, and the color-difference signal Pb is varied, there occurred a problem that the color to be actually displayed is made different; next, a circuit that solves this problem will be described.

Figure 2:
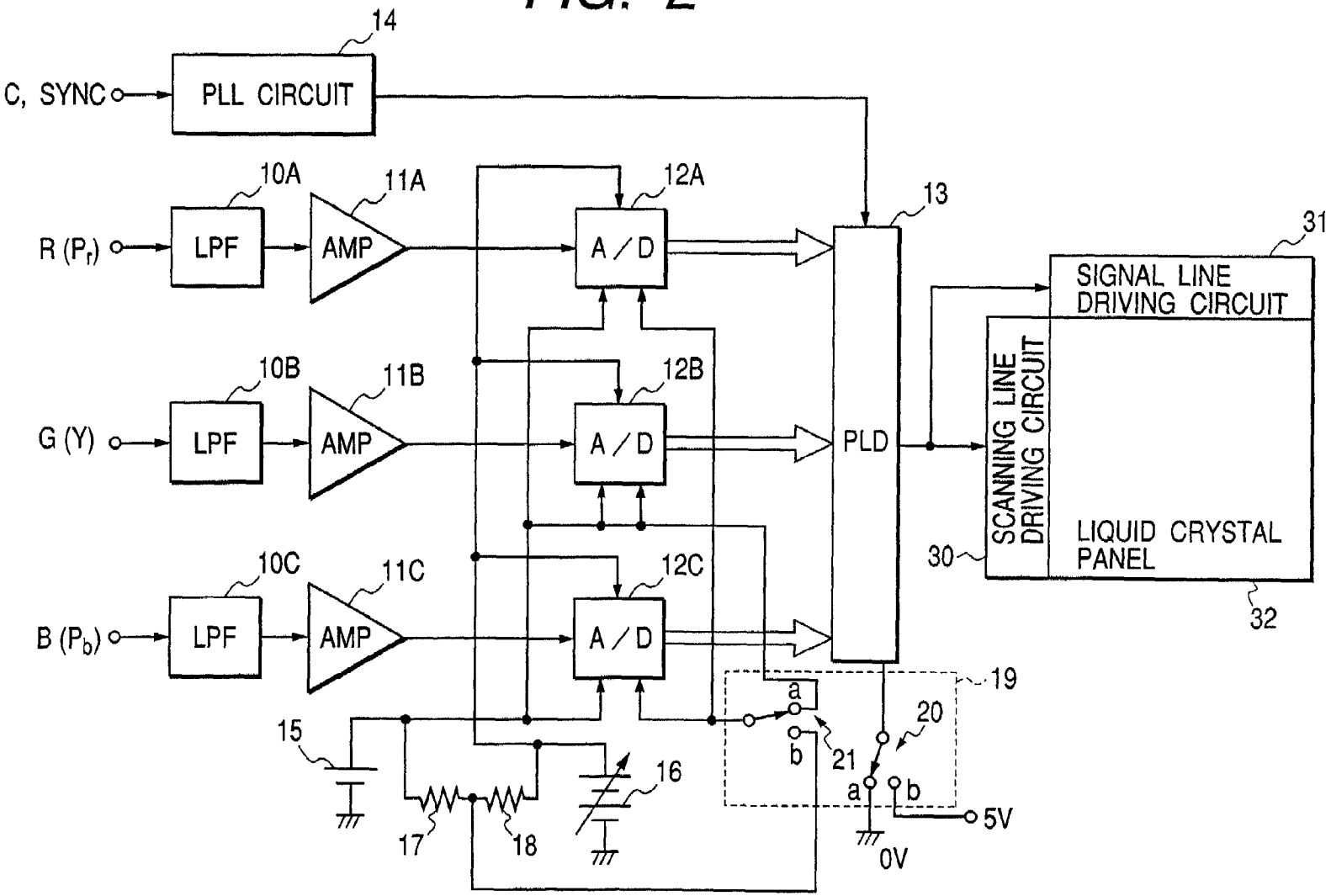
FIG. 2 is a block diagram to illustrate the total construction of the liquid crystal display according to the one embodiment of the invention.
Figure 4:
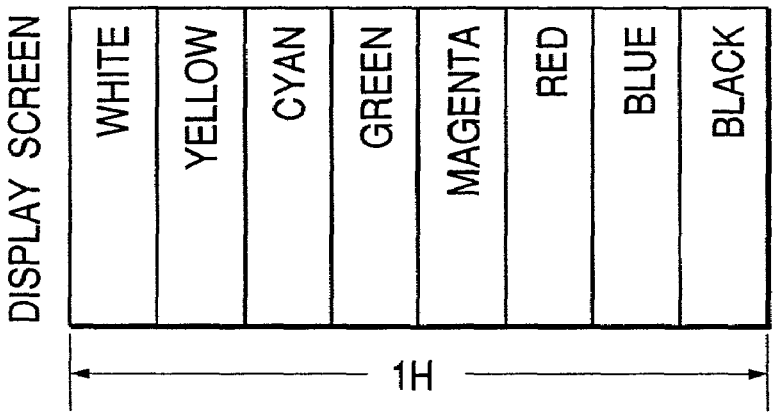
FIG. 4 PRIOR ART
FIG. 4 is a chart to illustrate the color bar.

FIG. 2 is a block diagram to illustrate the total construction of the liquid crystal display according to the one embodiment of this invention.

In FIG. 2, 10A through 10C denote low-pass filters to which the color-difference signal Pr, the luminance signal (Y), and the color-difference signal Pb, or the R signal, G signal, and the B signal, respectively, are inputted. Amplifiers 11A through 11C input the outputs from the low-pass filters 10A through 10C. These amplifiers 11A through 11C output to amplify the input signals with specific amplification factors. In the amplifiers 11A through 11C, the circuits to vary the amplification factors are omitted in the same manner as the amplifier 1 shown in FIG. 1. A/D converters 12A through 12C execute the sampling and quantization to the output signals from the amplifiers 11A through 11C, and output the digital signals.

In order to operate the A/D converters 12A through 12C, it is necessary to input the aforementioned upper limit voltage, the lower limit voltage, and the intermediate voltage, whose details will be discussed later.

The low-pass filters 10A through 10C have the RGB signals, or the color-difference signal Pr, the luminance signal (Y), and the color-difference signal Pb inputted thereto. Any one of these signals are inputted also to the A/D converters 12A through 12C; however, when the RGB signals are inputted, the intermediate voltage is varied to control the operation (the detail will be described later).

A reference numeral 13 signifies a PLD (Phase-lock Demodulator), to which the digital signals outputted from the A/D converters 12A through 12C are each inputted, and a synchronizing signal outputted from a PLL circuit 14 is inputted. The PLD outputs these signals synchronously with this synchronizing signal to a scanning line driving circuit 30 and a signal line driving circuit 31 which are located at a subsequent stage, and displays an image on a liquid crystal panel 32.

When the signals inputted to the low-pass filters 10A through 10C are the color-difference signal Pr, the luminance signal (Y), and the color-difference signal Pb, these signals are transformed into the RGB signals.

Further, when the RGB signals are inputted to the low-pass filters 10A through 10C, the processing to transform these into the RGB signals is omitted, and the inputted RGB signals are outputted synchronously with the synchronizing signal.

Next, the PLL circuit 14 will be explained.

Figure 3:
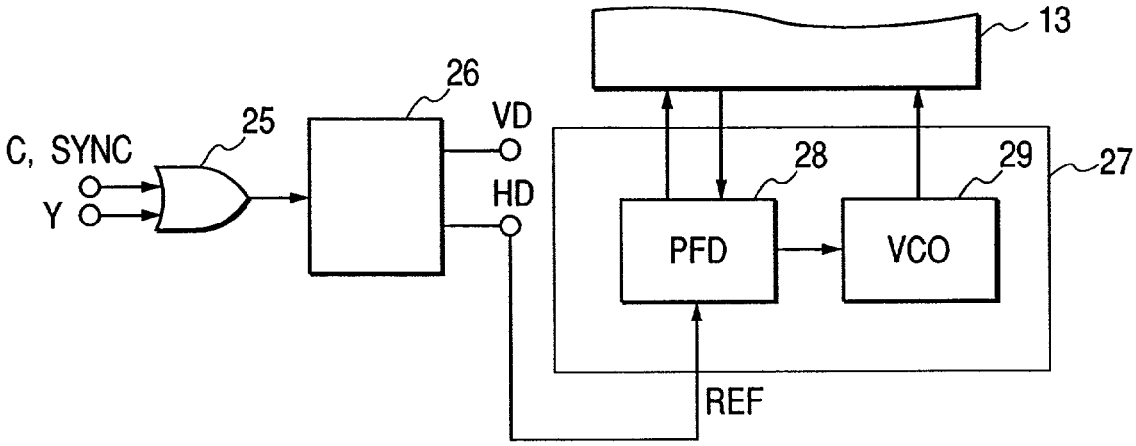
FIG. 3 is a block diagram to illustrate the internal construction of a PLL circuit 14.

FIG. 3 is a block diagram to illustrate the internal construction of the PLL circuit 14.

To the PLL circuit 14 is inputted the C, SYNC signal, namely, a decode synchronizing signal with the horizontal synchronizing signal and the vertical synchronizing signal mixed, and the luminance signal (Y).

Figure 6A:
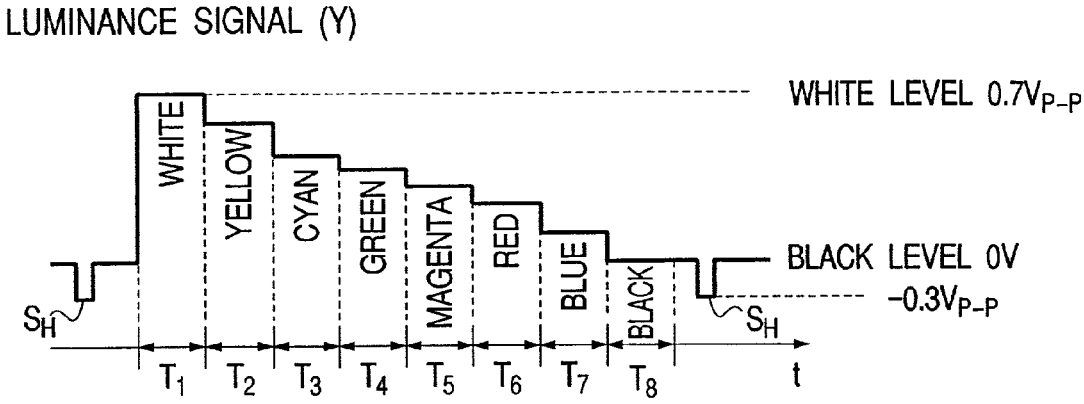
FIG. 6A PRIOR ART
FIG. 6 is a timing chart to illustrate the luminance signal and the color-difference signals that constitute one scanning line, when displaying the color bar shown in FIG. 4.
Figure 6B:
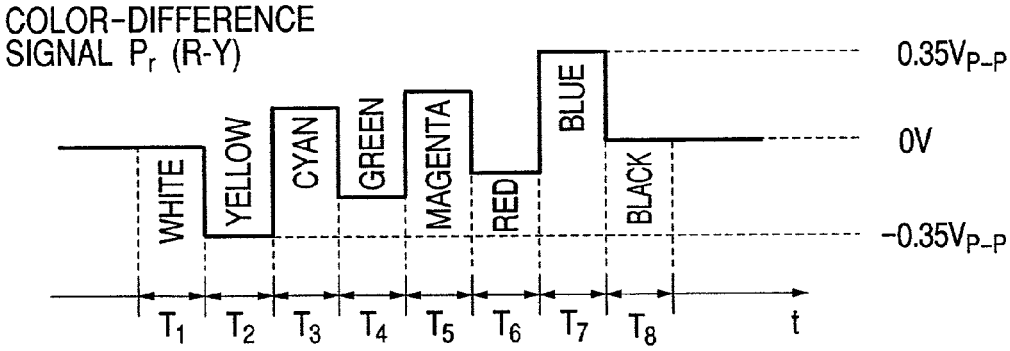
FIG. 6B PRIOR ART
Figure 6C:
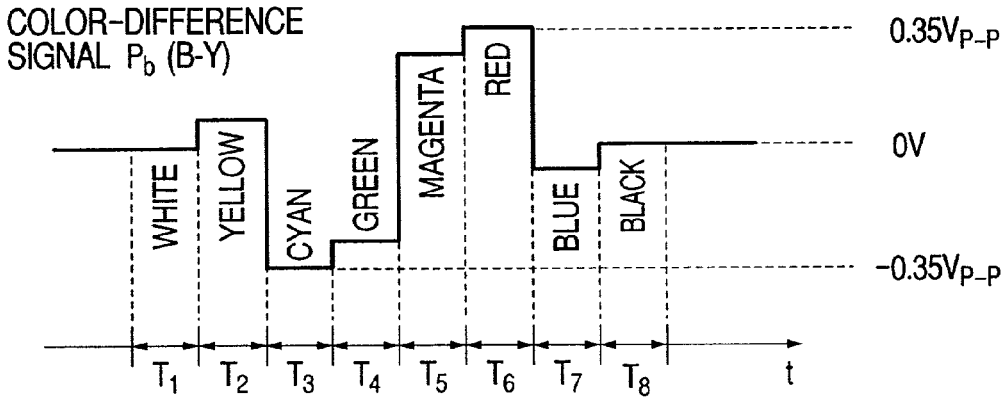
FIG. 6C PRIOR ART

A reference numeral 25 signifies an OR circuit where the decode synchronizing signal and the luminance signal (Y) are inputted. As understood from the composite signal shown in FIG. 6, there are a case where the synchronizing signal is superposed on the luminance signal (Y), and a case where it is not superposed (namely, a case with the luminance signal only). This OR circuit 25 is provided so that the synchronizing signal can be transmitted to the subsequent stage, even if the synchronizing signal is not superposed on the luminance signal (Y).

A reference numeral 26 signifies a synchronization separating circuit that extracts the horizontal synchronizing signal and the vertical synchronizing signal. The extracted vertical synchronizing signal VD is outputted to the PLD 13 (not illustrated), and the extracted horizontal synchronizing signal HD is outputted to the PLD 13 (not illustrated) and to a PLL circuit 27 as a reference signal REF.

The PLL circuit 27 comprises a PFD circuit (Phase Frequency Detector) 28 and a VCO (Voltage Controlled Oscillator) 29, which generates a constant frequency clock and outputs it to the PLD circuit 13.

The VCO 29 outputs to the PLD 13 a clock which has a specific frequency corresponding to a voltage outputted from the PFD 28.

The PFD 28 compares a phase of the signal outputted from the PLD 13 with a phase of the reference signal REF outputted from the synchronization separating circuit 26, when the PLD 13 counts a specific number of pulses generated and outputted from the VCO 29, and transforms the comparison result into a voltage and outputs it.

Next, a reference numeral 15 denotes a power supply to determine the lower limit voltage that defines the minimum value of the input signals corresponding to the minimum value of the digital signals outputted from the A/D converters 12A through 12C. The voltage of this power supply is fixed.

A reference numeral 16 denotes a variable power supply to determine the upper limit voltage that defines the maximum value of the input signals corresponding to the maximum value of the digital signals outputted from the A/D converters 12A through 12C. This variable power supply is able to vary the output voltage to adjust the contrast.

A reference numeral 17 signifies a resistor, one end of which is connected to the power supply 15 and the A/D converters 12A through 12C. 18 signifies a resistor, one end of which is connected to the variable power supply 16 and the A/D converters 12A through 12C. The other ends of these resistors 17, 18 are connected to each other. The resistors 17, 18 are to acquire the intermediate voltage between the upper limit voltage defined by the variable power supply 16 and the lower limit voltage defined by the power supply 4. The node of these resistors 17, 18 is connected to a switch circuit 19

The switch circuit 19 is to switch the operations of the A/D converters 12A through 12C and the PLD 13, depending on what the signals inputted to the low-pass filters 10A through 10C are the RGB signals, or the luminance signal (Y), the color-difference signal Pr, and the color-difference signal Pb.

The switch circuit 19 includes a switch 20 and a switch 21. These switches 20, 21 are interlocked. That is, if the switch 20 is switched into the side of a terminal a, the switch 21 is also switched into the side of a terminal a; and if the switch 20 is switched into the side of a terminal b, the switch 21 is also switched into the side of a terminal b.

The switch 20 is connected to the PLD 13, and the terminal a is grounded and the terminal b is supplied with a power supply of 5 volts. This switch 20 is to make the PLD 13 determine the signals inputted to the low-pass filters 10A through 10C to be the RGB signals, or the luminance signal (Y), the color-difference signal Pr, and the color-difference signal Pb. If the switch 20 is on the side of the terminal a, the PLD 13 is supplied with 0 volt, and the PLD 13 recognizes that the RGB signals are inputted. On the other hand, if the switch 20 is on the side of the terminal b, the PLD 13 is supplied with 5 volts, and the PLD 13 recognizes that the luminance signal (Y), the color-difference signal Pr, and the color-difference signal Pb are inputted.

The switch 21 is to control the intermediate voltage supplied to the A/D converters 12A through 12C to thereby switch the operations of the A/D converters 12A through 12C. If the switch 21 is on the side of the terminal a, the RGB signals are inputted. Therefore, since it is inconvenient to set a new intermediate voltage for the RGB signals, the terminals of the A/D converters 12A through 12C where the intermediate voltage is inputted are connected to each other. In this case, the terminal where the upper limit voltage of the A/D converter 12B is inputted is short-circuited to the terminal where the intermediate voltage is inputted. Accordingly, the voltage supplied as the intermediate voltage to each of the A/D converters 12A through 12C is the upper limit voltage.

On the other hand, if the switch 21 is on the side of the terminal b, the A/D converter 12A and the A/D converter 12C are supplied with the intermediate voltage.

As mentioned above, since the terminal where the upper limit voltage of the A/D converter 12B is inputted is short-circuited to the terminal where the intermediate voltage is inputted, the intermediate voltage supplied to the A/D converter 12B is always the upper limit voltage. This is because the luminance signal (Y) does not need the intermediate voltage in itself.

The operation of the liquid crystal driving circuit relating to the liquid crystal display according to the embodiment of this invention will now be discussed.

(1) Case of the RGB Signals Being Inputted:

First, the switch 20 and the switch 21 are set to the side of the terminal a. Thereby, the PLD 13 recognizes the input signal to be the RGB signals, and the terminals of the A/D converters 12A through 12C where the intermediate voltage is inputted are connected to each other, where the upper limit voltage is supplied.

The horizontal synchronizing signal of the RGB signals is inputted to the PLL circuit 14. The PLL circuit 14 generates the phase-controlled horizontal synchronizing signal, which is supplied to the PLD 13.

On the other hand, the R signal, G signal, B signal are each inputted through the low-pass filters 10A through 10C to the amplifiers 11A through 11C, and are inputted to the A/D converters 12A through 12C after amplified with the specific amplification factors.

The RGB signals inputted to the A/D converters 12A through 12C are converted into 8-bit digital signals to be outputted to the PLD 13. The PLD 13 outputs the RGB signals to the subsequent liquid crystal driving circuit (not illustrated) synchronously with the synchronizing signal outputted from the PLL circuit 14.

(2) Case of the Luminance Signal (Y), the Color-Difference Signal Pr, and the Color-Difference Signal Pb Being Inputted:

First, the switch 20 and the switch 21 are set to the side of the terminal b. Thereby, the PLD 13 recognizes the input signal to be the luminance signal (Y), the color-difference signal Pr, and the color-difference signal Pb, and the A/D converters 12A through 12C are supplied with the intermediate voltage.

The horizontal synchronizing signal is inputted to the PLL circuit 14, and the phase-controlled horizontal synchronizing signal is inputted from the PLL circuit 14 to the PLD 13.

On the other hand, the luminance signal (Y), the color-difference signal Pr, and the color-difference signal Pb are each inputted through the low-pass filters 10A through 10C to the amplifiers 11A through 11C, and are inputted to the A/D converters 12A through 12C after amplified with the specific amplification factors.

The luminance signal (Y), the color-difference signal Pr, and the color-difference signal Pb inputted to the A/D converters 12A through 12C are converted into 8-bit digital signals that are defined by the upper limit voltage, the lower limit voltage, and the intermediate voltage, and outputted to the PLD 13. The PLD 13 converts the inputted signals into the RGB signals, and outputs the RGB signals converted to the subsequent liquid crystal driving circuit (not illustrated) synchronously with the synchronizing signal outputted from the PLL circuit 14.

In any of the cases (1), (2), the contrast adjustment varies the output voltage of the variable power supply 16 that defines the upper limit voltage. In this case, only varying the output voltage of the variable power supply 16 will vary the upper limit voltage to the A/D converter 12A, the upper limit voltage to the A/D converter 12B, and the upper limit voltage to the A/D converter 12C with one and the same value.

Therefore, the lower limit voltage being fixed, the magnitudes of the reference voltage ranges (these determine the upper limit voltage and the lower limit voltage) become one identical magnitude, which is given to each of the A/D converters 12A through 12C.

Also, the A/D converter 12A and the A/D converter 12C need the intermediate voltage, but this value is automatically acquired by the resistors 17, 18, and an identical intermediate voltage is to be supplied to the A/D converter 12A and the A/D converter 12C. Therefore, the value of the intermediate voltage is not required to be adjusted in association with the variation of the upper limit voltage.

Thus, the method of this embodiment will not create a color difference in the contrast adjustment, which is the usual case with the conventional.

The foregoing embodiment has discussed a case where the luminance signal Y, the color-difference signal Pr, and the color-difference signal Pb of the video signal of the HDTV system are inputted to the A/D converters 12A through 12C and processed therein. However, the liquid crystal display of this invention functions even in a case where the luminance signal Y, the color-difference signal Pr, and the color-difference signal Pb of the video signal of the NTSC system or the PAL system are inputted to the A/D converters 12A through 12C, equally to the case of the video signal of the HDTV system. Incidentally, when the video signal of the NTSC system or the PAL system is inputted to the A/D converters 12A through 12C, each digital signals outputted from the A/D converters 12A through 12C are transformed into the RGB signals by the PLD 13 on the basis of the following arithmetic expression.

$$R=Y+Pr$$

$$B=Y+Pb$$

$$G=Y-0.51Pr-0.19Pb$$

Thus, the liquid crystal display according to this invention is effective in the video signal of the HDTV system, the NTSC system, or the PAL system, and it demonstrates the same effect against the video signal of any of the systems.

As described above, this invention exhibits an effect that only varying the magnitudes of the reference voltage ranges by the setting means facilitates the contrast adjustment.

Further, the device construction being simple, the external noises are difficult to be merged in, and the picture quality is difficult to be deteriorated, which is another effect of the invention.

Furthermore, to vary the magnitudes of the reference voltage ranges automatically varies the intermediate value between the maximum and the minimum of the reference voltage ranges, which makes the adjustment of the intermediate value unnecessary.

What is claimed is:

1. A liquid crystal display, comprising:

a plurality of converters that convert a luminance signal and two color-difference signals of an input video signal into digital signals, each digital signal corresponding to one of the luminance and color-difference signals;

a plurality of setting circuits that set magnitudes of reference voltage ranges to determine upper limit voltages and lower limit voltages of the digital signals to be identical in each of the converters, each setting circuit including:

a variable power supply connected to one of the converters, the variable power supply to determine the upper limit voltage that defines a maximum value of the input signal to said one of the converters corresponding to a maximum value of the digital signal outputted from said one of the converters, the variable power supply to permit a contrast adjustment of picture images, and a second power supply connected to said one of the converters, the second power supply to determine the lower limit voltage that defines a minimum value of the input signal to said one of the converters corresponding to a minimum value of the digital signal outputted from said one of the converters; and a plurality of intermediate voltage circuits that set intermediate voltages between the upper limit voltages and the lower limit voltages, the intermediate voltage circuits to input the intermediate voltages into the converters corresponding to said two color-difference signals.

2. A liquid crystal display according to claim 1, wherein each second power supply is a fixed power supply.

3. A liquid crystal display according to claim 1, each intermediate voltage circuit comprising:

a first resistor having a first end and a second end, the first end of the first resistor connected between the variable power supply and a respective converter of one of the two-color difference signals; and a second resistor having a first end and a second end, the first end of the second resistor connected between the second power supply and the converter of each of the two-color difference signals, and the second end of the first resistor and the second end of the second resistor connected to the respective converter.

4. A liquid crystal display according to claim 1, wherein one of said two color-difference signals is acquired by subtracting the luminance signal from a red signal and the other of said two color-difference signals acquired by subtracting the luminance signal from a blue signal.

5. A liquid crystal display, comprising:

a plurality of converters that convert a luminance signal and two color-difference signals of an input video signal into digital signals, each digital signal corresponding to one of the luminance and color-difference signals;

a setting circuit that sets magnitudes of reference voltage ranges to determine upper limit voltages and lowerlimit voltages of the digital signals to be identical in each of the converters, the setting circuit including:

a common variable power supply connected to the converters, the variable power supply to determine the upper limit voltage that defines a maximum value of the input signal to said one of the converters corresponding to a maximum value of the digital signal outputted from the converters, the variable power supply to permit a contrast adjustment of picture images, and a common second power supply connected to said converters, the second power supply to determine the lower limit voltage that defines a minimum value of the input signal to said converters corresponding to a minimum value of the digital signal outputted from said converters; and an intermediate voltage circuit that sets intermediate voltages between the upper limit voltages and the lower limit voltages, the intermediate voltage circuits to input the intermediate voltages into the converters corresponding to said two color-difference signals.

6. A liquid crystal display according to claim 5, the intermediate voltage circuit comprising:

a first common resistor having a first end and a second end, the first end of the first resistor commonly connected to a midpoint of a path connecting the common variable power supply and the converter of each of the two-color difference signals; and a second common resistor having a first end and a second end, the first end of the second common resistor connected to a midpoint of a path connecting the second common power supply and the converter of each of the two-color difference signals, and the second end of the first resistor and the second end of the second resistor connected to the respective converter.

7. A liquid crystal display according to claim 5, wherein the second power supply is a fixed power supply.

8. A liquid crystal display according to claim 5, wherein one of said two color-difference signals is acquired by subtracting the luminance signal from a red signal and the other of said two color-difference signals acquired by subtracting the luminance signal from a blue signal.

9. A liquid crystal display according to claim 1, wherein the intermediate voltage values correspond to a white level and a black level in each of the two color difference signals.

10. A liquid crystal display according to claim 5, wherein the intermediate voltage values correspond to a white level and a black level in each of the two color difference signals.

* * * * *